US006006823A

United States Patent [19]

Kiknadze et al.

[11] Patent Number: 6,006,823

[45] Date of Patent: Dec. 28, 1999

[54] STREAMLINED SURFACE

[76] Inventors: Gennady Iraklievich Kiknadze, Building 5, Flat 2, Marshall Riebalko Street No. 16, Moscow, 123463, Russian Federation; Ivan Alexandrovich Gachechiladze, Flat 96, Astrachanskij Street No. 5, Moscow, 129010, Russian Federation; Valery Grigorievich Oleinikov, Flat 6, 3 Kzestyanskaya Street No. 18, Mystishchi 141014, Moscow Region, Russian Federation

[21] Appl. No.: 09/059,724

[22] Filed: Mar. 13, 1998

Related U.S. Application Data

[63] Continuation of application No. 08/313,236, filed as application No. PCT/RU92/00106, May 18, 1992, abandoned.

[30] Foreign Application Priority Data

Mar. 31, 1992 [RU] Russian Federation ..... 5034292

[51] Int. Cl.[6] ..... F28F 13/18

[52] U.S. Cl. ..... 165/133; 165/181; 165/179

[58] Field of Search ..... 165/152, 151, 165/133, 166, 167, 181, 182, 109.1, 179

[56] References Cited

U.S. PATENT DOCUMENTS

| | | | |
|---|---|---|---|
| 3,664,928 | 5/1972 | Roberts | 165/166 X |
| 3,931,854 | 1/1976 | Ivakhnenko et al. | 165/166 |
| 4,420,039 | 12/1983 | Dubrovsky | 165/166 X |

FOREIGN PATENT DOCUMENTS

| | | | |
|---|---|---|---|
| 001776968 | 11/1992 | U.S.S.R. | 165/179 |
| 002002189 | 10/1993 | U.S.S.R. | 165/179 |
| 102 | 11/1887 | United Kingdom | 165/179 |

*Primary Examiner*—Christopher Atkinson

[57] ABSTRACT

The invention relates to hydroaerodynamics and to thermal physics and concerns devices to control the boundary and near wall layers in the flows of continuos media such as gases, liquids, their two-phase or multicomponent mixtures and the like, moving along ducts under no pressure or under pressure.

2 Claims, 1 Drawing Sheet

STREAMLINED SURFACE

This application is a continuation of U.S. application Ser. No. 08/313,236 filed Nov. 30, 1995 now abandoned and U.S. application Ser No. 08/313,236 is a 371 of PLT/RV92/00106 filed May 18, 1992.

The invention relates to hydroaerodynamics and to thermal physics and concerns devices to control the boundary and near wall layers in the flows of continuos media such as gases, liquids, their two-phase or multicomponent mixtures and the like, moving along ducts under no pressure or under pressure.

PRIOR STATE OF ART

The majority of widely used devices intended for heat-and-mass transfer intensification require considerable power consumption for pumping the heat carrier.

In the last ten years approaches to the problems under discussion have been developed, which are based on the utilization of the peculiarities of vortex dynamics of a continuous medium flowing past three-dimensional reliefs. Thus, according to U.S. Pat No. 3,741,285 devices are proposed, which are provided with wavy surfaces or with surface elements of such an amplitude such a deflection in the direction of the flow, bypassing these devices, and such a longitudinal and lateral distribution of these properties, which result in the creation and intensification of the vortices in the boundary layer.

In this case, in particular for elements having the shape of concavities, the recommended depth is 0.5 to 1.0 δ, where δ is the depth of the boundary layer, whereas the period of location of such elements is 3 to 20 δ. This limits the quantitative measures of the elements of the devices discussed by the author. In this, connection it should be noted, that the author of this Patent failed to make any advance towards the solution of the stated problem or to propose any concrete shapes of three-dimensional elements of the relief, with the exception of the geometrical constructions, which are directly not connected with the vortex dynamics mechanism.

Let us examine the inventions, in which claimed are these or other kinds of reliefs in the shape of convexities or concavities and which are mostly close to those proposed in the present application.

In the known U.S. Pat No. 4,690,211 the heat exchange tube is provided with at least one row of projections (convexities) on its internal surface along the spiral curve, and the outline of the cross section of these convexities consists of smooth curves in any part along the height of the projections, including the base. In this case the section area monotonically decreases towards the projection top, whereas the projection height is from 0.45 to 0.6 mm. The spiral curve is selected so that a "circumferential " pitch of 3.5 to 5 mm is obtained, whereas the pitch along the axis is 5 to 15 mm. In particular, the sections of the projections may have a circular, elliptical or extended shape.

However, the authors of the patent failed to point out the relations between the dimensions of the projections and pitches characterizing the layout of the projection, and the diameter of the tube and the conditions of flow of the heat carrier. The data presented by the authors are naturally applicable to tubes, the diameter of which is about 15 mm—the authors indicate the results of the thermophysical experiments only for tubes of the given diameter. Besides, the authors do not indicate the radii of the curvatures of the sections, on which the smooth portion of the tube changes over to form the projection surface. If one judges by the drawings of the given patent, such a transition is supposed to have a zero curvature radius. At the same time it is known that these curvature radii determine the value of the hydraulic resistance and hence the thermophysical efficiency. In addition, the patent contains no indication concerning the optimum, from the thermophysical point of view, relation of the projection height to its diameter though this relation strongly influences the heat transfer and hydraulic resistance measures.

It is obvious that since the turbulent flows of the heat carriers are three-dimensional even in case of establishing two-dimensional boundary conditions and since a three-dimensional relief is distinguished for its greater variety, thus ensuring the realizability of a larger number of degrees of freedoms in the velocity field in the near wall area of the flow, one should expect a high degree of thermophysical efficiency in case the appropriate three-dimensional relief is selected. However, even the simplest streamlining laws for three-dimensional reliefs have been investigated less than those of two-dimensional reliefs. This is connected both with the relative "young age " of the heat-and-mass transfer intensification methods by means of three-dimensional reliefs and with a larger variety of possibilities and parameters, which are characterisitic of three-dimensional reliefs. This also explains the schematism and absence of important geometrical parameters of three-dimensional reliefs in the above application, as well as the absence of the relation between these parameters and the conditions of flow and other flow characteristics of the heat carriers.

DISCLOSURE OF THE INVENTION

The main aim of this invention if to develop a device for controlling the heat-and -mass transfer processes, hydraulic resistance, boiling the deposition of admixtures from flows in the boundary or near wall layers of gas, liquid, their two-phase or multicomponent mixtures moving in ducts under no pressure or under pressure; control shall be achieved by initiating the generation of large-scale vortex structures and by controlling their development.

The forwarded problem is solved by means of a device—a streamlined surface or a heat-and-mass transfer surface, which is the separation boundary between the flowing continuous medium: gas, liquid, their two-phase or multicomponent mixtures and a solid wall (initially smooth, cylindrical, conical, or of any other profile), which permits controlling the process in the boundary layer or in the near wall layers of the flow due to the creation on its surface of a three-dimensional concave or convex relief with smooth outlines and ranges of dimensions characterizing this relief and being associated with the hydrodynamical lengths describing the processes in the boundary and near wall layers of the flow. The three-dimensional relief is made in the form of concavities or convexities with rounded sections and a transition located in a checkered or unstaggered order, and any section of the concavities or convexities along the streamlined surface will have the shape of a smooth closed line described by the relation $$r(\varphi, z) = (z/h)^k[r(h, 0) - lc/2 + \Delta r(\varphi/180 - (1/4\pi)\sin(4\pi\varphi/180)) + A_1\Delta r(\sin(\pi\varphi/180) - (1/3)\sin(3\pi\varphi/180)) + A_2\Delta r(\sin(2\pi\varphi/180) - (1/2)\sin(4\pi\varphi/180))],$$

where:

r(ϕ, z)—is the section radius in the direction of angle ϕ, counted from the line interconnecting the centers of the adjacent concavities or convexities, or from any other line, which lies in the indicated section;

z—is the section height over the lowermost point of the concavity or the section distance from the uppermost point of the convexity;

r (h,o)—is the radius of the concavity or convexity section in the direction of angle $\phi=0°$;

$\Delta r=r(h, 180)-r(h, 0)$—is the difference between the radii of the concavities or convexities in the direction of angles $\phi=180°$ and $\phi=0°$;

lc—is the dimension of the curvature area projected onto a plane extending parallel to the streamlined surface; k=0.3 to 0.7 is the coefficient;

$$\left.\begin{array}{l} -1 < A_1 < 1, \\ -1 < A_2 < 1 \end{array}\right\} \text{– coefficients of the shape of the section}$$

coefficients of the shape of the section the depth of the cavities or convexities $h$ is 0.005 to 0.3 of the thickness of the boundary layer or of the equivalent hydraulic diameter of the duct, the curvature area of the concavities or convexities has, in a plane perpendicular to the streamlined surface, a common tangent with the transition area, which is located between the adjacent concavities or convexities and which is made in the shape of a bicurvature surface with radii $R_{c1}$, $R_{c2}$ meeting the following relations:

$$|R_{c1}| \geq 3h \quad \text{and} \quad |R_{c2}| \geq 3h$$

and whereby the dimension D of the concavities or convexities along the streamlined surface is:

$$D=(2 \text{ to } 40)h$$

the dimension of the curvature area along the streamlined surface is:

$$lc=(0.05 \text{ to } 0.03)D$$

whereas the dimension of the transition area along the line interconnecting the centers of the adjacent concavities or convexities is:

$$ltr=(0.05 \text{ to } 3)D$$

The concavities or convexities may be located in the vertices of the parallelograms, the lengths of the sides of which are within the range of 1.05 to 4 dimensions of the concavities or convexities and the vertex angle $\alpha_p$ is 20 to 90°.

The relations, which characterize the indicated relief of the concavities and convexities, have been obtained as a result of processing the thermophysical measurements.

BRIEF DESCRIPTION OF THE DRAWINGS

Illustrated in FIG. 1 is the concavity relief section across the streamlined surface.

BEST EMBODIMENT

Figure 1:
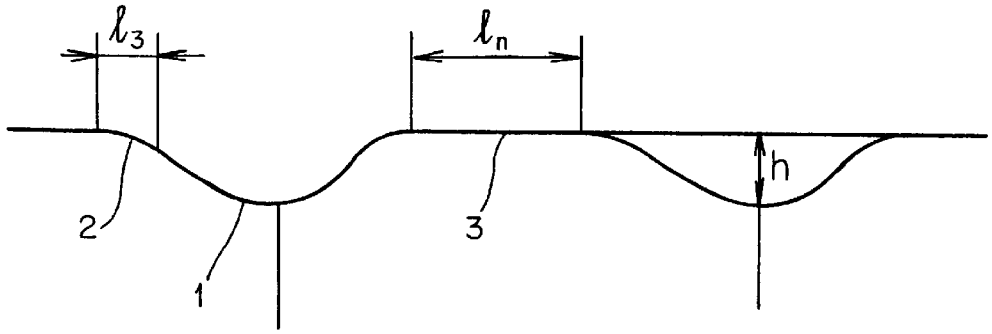
Figure 2:
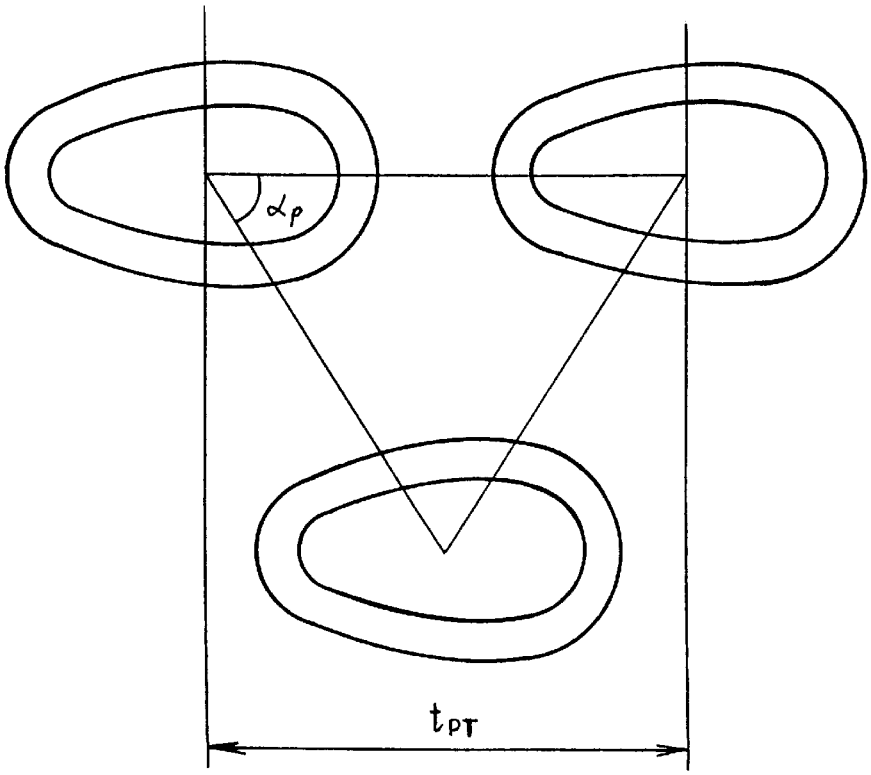
FIG. 2 presents the top view on the streamlined surface.

The convexities relief section across the streamlined surface is similar to the relief section of the concavities shown in FIG. 1.

The streamlined surface consists of concavities (1) (convexities), which include curvature areas (2) and transition areas (3).

When a continues medium flow runs past a surface provided with concavities (convexities) containing elements of the indicated dimensions in the near wall area at a distance of 0.005 to 0.3 thickness of the boundary layer or an equivalent hydraulic diameter of the duct, three-dimensional velocity and pressure fields of the continuous medium are formed, The three-dimensional features of the velocity and pressure fields alongside with the inertia forces, which originate in the near wall layers of the flow due to running of the flow past the convexities or concavities, result in the generation of Goertler vortices and other large-scale vortex structures, including tornado-like ones. The indicated ranges of the dimensions of the concavity or convexity elements ensure generation of vortex structures resulting in their self-organization, which is favorable from the point of view of the intensification of the heat-and-mass transfer and of the other processes, which take place in the boundary or near wall layers of the continuous medium flow.

The smooth shapes of the three-dimensional relief of concavities or convexities, the presence of a transition area in the shape of a bicurvature surface between the concavities or convexities ensure, according to proposed invention, the dynamical properties of the large-scale vortex structures and the possibility of their alignment with the main flow; this has found its expression in the lagging increase of the hydraulic resistance as compared with the increase of the heat of mass transfer intensity, and in some cases there is even a decrease of the hydraulic resistance as compared with the hydraulic resistance of smooth surfaces.

In addition, the realization of the proposed device results in a visible decrease of deposition of foreign impurities from the heat carrier onto the streamlined surface. This fact is connected with the directiess of the generation of Goertler and tornado-like vortex structures, which increases the transfer of the mass, the admixtures included, from the wall away into the flow core.

According to the invention, the smoothness of the streamlined relief ensures also an increased corrsion resistance of the streamlined surface when continous media are used, which usually involve corrosion processs. According to the data of the experiments, the pecuiarities of the mass transfer, originating due to the genertion of large-scale vortex structures, decrease the probablity of the origination of electrochemical processes on the surface of the claimed device provided with a relief.

The use of a three-dimensional concavity or covexity relief of the indicated parameters results in a noticeable increase of the critical heat flows within a wide range of liquid pressure, mass velocity of the heat carrier and a relative vapor content. The shift of the critical hat transfer towards high thermal loads a the flow runs st the surface provided with the indicated relief, is caused by the formation of a heated surface of large-scale self-organizing structures, tornado-like structures included, by mean of which the vapour bubbles are evacuated from the area surrounding the concavity or convexity and taken away from the near wall layer into the flow core. Favorable to this is also the smoothness and the three-dimensional features of the relief, since they contribute to the change of the directions of the orientation and twisting of the vortex structures.

INDUSTRIAL USE

The invention may be used in various power engineering and heat-and-mass transfer systems, as well as in any other branches where there is a demand in intensificatin of the heat-and-mass transfer at a limited increase of the hydraulic resistance. In particular, the invention is used with various kinds of transportation facilities, i gas turbine units with cooled blades, in nuclear power assemblies with high-flow neutron sources, in stea generators, heat exchangers, as well as in other energy transfer apparatuses and devices.

We claim:

1. A streamlined surface, which ensures control of a process in boundary and near wall layers of continuous medium flows and which is provided with a three-dimensional relief characterized by said three-dimensional relief being made in the shape of said concavities or convexities (1),
curvature areas (2) and
transition areas (3), and whereby any section of said concavities (1) or convexities along said streamlined surface has a shape of a smooth close line, described by the following relation:

$$r(\varphi, z) = (z/h)^k [r(h, 0) - lc/2 + \Delta r(\varphi/180 - (1/4\pi)\sin(4\pi\varphi/180)) + A_1 \Delta r(\sin(\pi\varphi/180) - (1/3)\sin(3\pi\varphi/180)) + A_2 \Delta r(\sin(2\pi\varphi/180) - (1/2)\sin(4\pi\varphi/180))],$$

where:

$r(\phi,z)$ is a section radius in a direction of angle $\phi$ counted from a line interconnecting centers of adjacent concavities or convexities, or from any line, which lies in said section;

z is a section height over a lowermost point of a concavity or section distance from an uppermost point of convexivity;

r (h,o) is a radius of the concavity or convexity section in the direction of angle $\phi=0°$;

$\Delta r=r(h, 180)-r(h, 0)$ is the difference between radii of the concavity or convexity section in the direction of angles $\phi=180°$ and $\phi=0°$;

lc is the dimension of a curvature area projected onto a plane extending parallel to said streamlined surface;

k=0.3 to 0.7 is a coefficient;

$-1<A_1<1$, —is a coefficient of the shape of the section, $-1<A_2<1$, —is a coefficient of the shape of the section, the depth of the concavities (1) or convexities h is 0.0005 to 0.3 of the thickness of the boundary layer or of the equivalent hydraulic diameter of a duct, the curvature area (2) of the concavities or convexities has, in a plane perpendicluar to the streamlined surface, a common tangent with the transition area (3), which is located between the adjacent concavities (1) or convexities and which is made in a shape of a non linear bicurvature surface with radii $R_{c1}$, $R_{c2}$ meeting the following relations:

$$|R_{c1}| \geqq 3h \text{ and } |R_{c2}| \geqq 3h$$

whereby a dimension D of the concavities (1) or convexities along the streamlined surface is $$D=(2 \text{ to } 40)h,$$

the dimensional $l_c$ of the curvature area (2) along the streamlined surface is $$\rho_c=(0.05 \text{ to } 0.3)D,$$

whereas the dimensional $l_{tr}$ of the transitional area (3) along the line interconnecting the centers of the adjacent concavities (1) or convexities is $$l_{tr}=(0.05 \text{ to } 3)D.$$

2. The surface claimed in claim 1 characterized in that the centers of the concavities (1) or convexities are located in vortices of a parallelogram, lengths of sides of which are within the range of 1.05 to 4 dimensions of the concavities (1) or convexities and a vertex angle is $\alpha_p$=20 to 90°.

* * * * *